United States Patent [19]

Nagle

[11] Patent Number: 4,699,124

[45] **Date of Patent: * Oct. 13, 1987**

[54] PROCESS FOR CONVERTING CELLULOSE TO GLUCOSE AND OTHER SACCHARIDES

[75] Inventor: Richard T. Nagle, Upper Montclair, N.J.

[73] Assignee: Power Alcohol, Inc., Hasbrouck Heights, N.J.

[ * ] Notice: The portion of the term of this patent subsequent to Jan. 20, 2004 has been disclaimed.

[21] Appl. No.: 876,048

[22] Filed: Jun. 19, 1986

Related U.S. Application Data

[63] Continuation-in-part of Ser. No. 774,071, Jun. 28, 1985, Pat. No. 4,637,835.

[51] Int. Cl.[4] ..... C13K 1/02

[52] U.S. Cl. ..... 127/37; 127/1

[58] Field of Search ..... 127/37, 1

[56] References Cited

U.S. PATENT DOCUMENTS 4,018,620 4/1977 Penque ..... 127/37

FOREIGN PATENT DOCUMENTS 44622 1/1982 European Pat. Off. ..... 127/37

96497 12/1983 European Pat. Off. ..... 127/37

OTHER PUBLICATIONS

Chemical Abstract, vol. 66, No. 22, issued May 29, 1986, Tyshetskaya et al, "The Application of the Method of Salt (Extraction) Retification of the Decomposition of Hydrochloric Acid in the Production of Glucose by [Wood] Hydrolysis", p. 9055, Abstract No. 96377q.

*Primary Examiner*—Andrew Metz

*Assistant Examiner*—Chung K. Pak

*Attorney, Agent, or Firm*—Caesar, Rivise, Bernstein, Cohen & Pokotilow, Ltd.

[57] ABSTRACT

A method of hydrolyzing cellulose to glucose and other saccharides, involving the bringing together in a reaction area an alphacellulose containing material, water, an effective amount of a calcium chloride catalyst and a minor amount of HCl. The temperature of said reaction mixture is adjusted to between 150° C. to 250° C. at a pressure of at least 160 psig for a retention time of at least 10 seconds in the reaction area to convert the alphacellulose to glucose and other saccharides. The method involves the use of HCl on a total mass basis, ranging from 0.025% to 1.0% by weight of the reaction mixture which is fed into the reactor.

3 Claims, No Drawings

PROCESS FOR CONVERTING CELLULOSE TO GLUCOSE AND OTHER SACCHARIDES

This application is a continuation-in-part application based on prior filed application Ser. No. 774,071, filed Jun. 28, 1985, now U.S. Pat. No. 4,637,835 and entitled Methods of Hydrolyzing Cellulose to Glucose and Other Saccharides.

BACKGROUND OF THE INVENTION

This invention relates to methods of hydrolyzing cellulose to glucose and other saccharides and is most particularly related to new and improved industrial processes of this general class. As used the term saccharides includes the various mono and (poly) saccharides that will readily occur to those skilled in the art, which are capable of being produced by the process of the present invention.

Trees and agricultural plants consist of three main components, cellulose, hemicellulose and lignin. Cellulose which is a polymer of glucose is held together by glycosidic bonds. It occurs in both amorphous and crystalline forms. The crystalline cellulose is a densely packed crystal structure which makes hydrolysis difficult. However, the C-O glycosidic bond is the weakest in the chain and can be broken by specific enzymes or chemical reagents into its component sugars.

It has further been proposed in U.S. Pat. No. 4,018,620 the disclosure of column one, lines 8 to 61 of said patent being incorporated herein by reference, to hydrolyze cellulose to monosaccharides in a hydrolysis process. The hydrolysis process of U.S. Pat. No. 4,018,620 involves admixing cellulose, water, at least 5% $CaCl_2$ and about 0.01% to about 2% HCl, heating the reaction mixture to solubilize the cellulose until reducing sugars are formed from the solubilized cellulose.

It has been determined that the process of U.S. Pat. No. 4,018,620 results in a low yield and therefore is unsatisfactory for commercial purposes. While the abstract U.S. Pat. No. 4,018,620 mentions pressure and while said patent also in column 5, line 51 mentions "increased pressures", there is nothing in U.S. Pat. No. 4,018,620 to teach which particular increased pressures were contemplated. Also the lengthy reaction times of U.S. Pat. No. 4,018,620 strongly favor the formation of unwanted by-products.

Accordingly, it is an object of the present invention to provide methods of hydrolyzing cellulose to glucose and other (poly)saccharides which achieve a relatively high yield to produce preferably glucose under commercially acceptable conditions of great economy.

The present invention involves the bringing together of a cellulose containing material or materials, water, a $CaCl_2$ catalyst and a minor amount of HCl or other acid under the prescribed conditions of temperature, pressure and retention time to achieve significantly higher yields in converting cellulose to glucose.

In the preferred method it is possible to use a wide variety of alphacellulose containing materials. These materials can be provided in various forms, such as, sawdust, wastepaper, corn stover, cattails, confetti, newsprint, wheat straw and brewer's dried grain.

All percentages to be expressed hereafter shall be by weight based on the total weight or mass of the reaction mixture as fed into the reactor. The weight of steam to heat the reaction mixture is not included.

The $CaCl_2$ catalyst in cry form is present on a total mass basis in an amount of approximately 5% by weight to 60% by weight. Actually, the $CaCl_2$ catalyst is preferably introduced into the system in an aqueous saturated solution.

The HCl or other acid is present on a total mass basis in an amount of from 0.025% to 1.0%, with reaction time becoming increasingly shorter as the amount of HCl is increased toward 1% and beyond. Also, there is the formation of higher amounts of unwanted by-products as the amount of HCl is increased.

Although the mechanism of the present hydrolysis reaction has not been definitely ascertained, it is believed that the HCl or other acid decreases ionization, and in this way acts as a triggering agent to prompt the hydrolysis reaction.

Also, the setting of a particular pressure facilitates the holding of the temperature in the range of 150° C. to 250° C., with the preferred range being from 185° C. to 205° C. The precise temperature or temperature range within the above-stated ranges will vary depending upon the alphacellulose composition of the feedstock. Preferrably the process is operated for maximum conversion of cellulose to glucose, for the particular feedstock material or materials being handled.

At temperatures significantly below 175° C., the reaction proceeds extremely slowly. The upper limit of the preferred temperature is set at 205° C. since operation at temperatures significantly beyond 205° C. will cause burning and create unwanted degradation products.

Also, pressure is quite important for the successful carrying out of the present invention. It has been determined that the pressure should be at least 160 psig. Present testing has shown successful carrying out the present invention at pressures as high as 800 psig, although there is no intention to place an upper limit on the pressure. Of course, from a financial or cost standpoint there is a practical upper limit to pressure beyond 800 psig. In operating the present process, the degree of pressure will be usually determined by the particular temperature of operation and the tightness of the system.

It is believed that pressure is important to achieve good physical contact between the $CaCl_2$ catalyst and the cellulose molecules. Indeed, it is believed that pressure significantly above 160 psig, but usually less than 800 psig is necessary to obtain rapid penetration of the catalyst into the cellulose containing materials.

The $CaCl_2$ catalyst is preferably present in an amount which is close to the maximum saturation of $CaCl_2$ in an aqueous solution. For example, if the cellulose-containing material is approximately 35% of the total weight, the balance is basically the catalyst solution. In this particular instance, the maximum theoretical percentage of $CaCl_2$ on a total solids basis will be approximately 40%.

Another important feature of the invention is that the retention time in the reaction area preferably does not exceed 20 seconds and is usually more than 10 seconds, although shorter times are contemplated. Beyond this time period secondary reactions set in to produce increasingly greater amounts of unwanted by-products, such as furfural, 5-hydromethylfurfural (HMF), acetic acid, formic acid, levulinic acid, nonenzymatic browning and/or Maillard products. However the present invention does contemplate retention times, somewhat in excess of 20 seconds and up to 1 minute and possibly longer, provided there is a minimal acceptable production of unwanted by-products.

The actual water content of the feed material to the reaction area comes from several sources. First, the cellulose containing material has a considerable amount of physically or chemically bound water content that can be as high as 50%. For instance, dry newsprint is perhaps the lowest in bound water content, usually containing about 9% moisture. On the other hand corn stover will be quite high in the area of approximately 50% moisture content. Sawdust is a bit lower at 40%.

There is also water present in the $CaCl_2$ solution as well as in the HCl solution that is added to the reaction mixture. Finally, where dry steam is used there will be an additional source of water. All four sources of water must be taken into account and calculated to determine the total amount of water present.

The present invention occurs in a stirred, pressure vessel operated in a batch mode. The cellulose-containing material and aqueous saturated calcium chloride solution are charged into the reactor and the port bolted closed. The vessel is steam heated to the desired operating temperature, preferably in the range of 185° C.–205° C. Next, the acid is injected and the vessel further pressurized. The mixture which is at the desired temperature is held for approximately 10–20 sec.

After the reaction occurs in the reaction area to hydrolize the cellulose to glucose and other (poly)saccharides, the temperature of the products of the reaction is immediately lowered in the next section of the system to less than 100° C. in a very short period of time, perferably no longer than 1 second. This can be achieved by passage of the reaction products to a product reservoir. The product reservoir under vacuum thereby releases pressure from the reaction products and causes the volatiles to flash off. These volatiles include HMF, furfural and HCl as well as others. It is important that the temperature of the reaction products be preferably cooled below 85° C. to avoid degredation of the glucose.

From the product reservoir, the product stream must be filtered and the filtrate further processed to separate the calcium chloride from the glucose syrup. Among the solids that are obtained as a product of filtration is lignin which may be valuable.

The filtrate is sent through an ion retardation column. The $CaCl_2$ is retained on the column and the sugar passes through the column. A separation of over 90% can be achieved. The calcium chloride now separated can be re-used. The glucose-containing syrup which contains some residual calcium chloride may be subject to further treatment depending upon the final use of said stream.

Certain by-products are produced. These include, in addition to lignin, xylose and other sugars, HMF, furfural and other related components.

The process may be carried out in two stages. The first stage will be solubilize and hydrolyze the hemicellulose component into its component sugars. This preparatory step may be carried out using procedures well known to those skilled in the art.

The following description is for carrying out the process on a continuous scale. The cellulose-containing material is fed to a slurry tank where it will be mixed with an aqueous calcium chloride stream. The slurry is then pumped to a continuous reactor where it is brought to the required reaction temperature with steam. In the same reactor, the reaction is triggered by a small quantity of hydrochloric acid, in the range of 0.025%–1.0% (w/w). The overall reaction time will be on the order of 5–20 seconds during which time the material is maintained within the reactor by a back pressure control valve. Immediately after the back pressure control valve, products are flash into a flash chamber. In the flash chamber; the volatiles are separated from the non-volatiles. The non-volatiles are pumped to a filter. The filter cake will be washed to remove the bulk of the sugars and is sent to waste treatment. The filtrate is neutralize and sent through an automatic, moving ion retardation bed in which the sugars are separated from the non-sugars with an efficiency of over ninety percent in one pass. The nonsugar solution obtained is rich in catalyst and is concentrated in a mechanical vapor recompression falling film evaporator. The concentrated catalyst solution is recycled to the slurry tank.

The following examples illustrate said invention:

EXAMPLE 1

Mixture of $CaCl_2$ and yellow pine was charged into the vessel. The yellow pine contained 45% w/w cellulose. The mixture contained:

| | | |
|---|---|---|
| Yellow Pine | 1,000 g | 9.41% w/w |
| Calcium chloride | 5,870 g | 55.26% w/w |
| Hydrochloric acid | 30 g | 0.29% w/w |
| Water | 3,722 g | 35.04% w/w |

The mixture was heated in the vessel at 190° C. Once mixture reached desired temperature, the acid was injected. The mixture was held for 15 sec. and then released into the holding vessel. The contents were analyzed for glucose, HMF, xylose and furfural using High Pressure Liquid Chromatography (HPLC). The results were as follows:

| | |
|---|---|
| Glucose | 264.1 g |
| HMF | 39.9 g |
| Xylose | 19.3 g |
| Furfural | 27.5 g |

Conversion of cellulose to glucose=58.7%.

EXAMPLE 2

Mixture of $CaCl_2$ and oak flour was charged into the reactor. The oak flour contained 41.6% w/w cellulose. The mixture was as follows:

| | | |
|---|---|---|
| Oak Flour | 500 g | 7.15% w/w |
| Calcium chloride | 3,900 g | 55.80% w/w |
| Hydrochloric acid | 56 g | 0.80% w/w |
| Water | 2,533 g | 36.24% w/w |

The mixture was heated in an agitated batch reactor at 200° C. Once mixture reached this temperature, the acid was injected. The mixture was held for 10 seconds and then released into the product reservoir. The contents were analyzed for glucose, HMF, xylose, and furfural using HPLC. The results were as follows:

| | |
|---|---|
| Glucose | 144.7 g |
| HMF | Traces |
| Xylose | 99.0 g |
| Furfural | 5.5 g |

Conversion of cellulose to glucose=62.7%

EXAMPLE 3

Mixture of $CaCl_2$ and coniferous wood chips was charged in the reactor. The wood chips contained 41% w/w cellulose. The mixture contained:

| | | |
|---|---|---|
| Wood chips | 1,000 g | 10.83% w/w |
| Calcium chloride | 5,000 g | 54.15% w/w |
| Hydrochloric acid | 40 g | 0.43% w/w |
| Water | 3,193 g | 34.58% w/w |

The mixture was heated in the vessel at 200° C. Once the mixture reached this temperature, acid was injected. The mixture was held for 12 sec. and then released into the holding vessel. The contents were analyzed for glucose, HMF, xylose and furfural using HPLC. The results were as follows:

| | |
|---|---|
| Glucose | 330.0 g |
| HMF | 12.1 g |
| Xylose | 94.0 g |
| Furfural | 7.0 g |

Conversion of cellulose to glucose=80.5%

EXAMPLE 4

Mixture of $CaCl_2$ and yellow pine wood chips was charged into the reactor. The yellow pine contained 41% w/w cellulose. The mixture contained:

| | | |
|---|---|---|
| Cellulose | 2,000 g | 18.83% w/w |
| Calcium chloride | 5,230 g | 49.25% w/w |
| Hydrochloric acid | 44 g | 0.41% w/w |
| Water | 3,346 g | 31.51% w/w |

The mixture was heated in the vessel at 199° C. Once mixture reached this temperature, acid was injected. The mixture was held for 25 sec. and then released into the product reservoir. The contents were then analyzed for glucose, HMF, xylose and furfural. The results are as follows:

| | |
|---|---|
| Glucose | 555.0 g |
| HMF | 191.0 g |

Conversion of cellulose to glucose=67.7%

From all of the foregoing it can be seen that the present invention provides methods of hydrolyzing cellulose to glucose and other (poly)saccharides and that such methods achieve a significant yield, producing mainly glucose under commercially acceptable conditions of great economy. In accordance with the method of the present invention the feedstock temperature, reaction area pressure and reaction retention time are controlled within specified limits in order to achieve the beneficial results of the present invention.

Without further elaboration, the foregoing will so fully illustrate my invention that others may, by applying current or future knowledge, readily adopt the same for use under various conditions of service.

I claim:

1. A method of hydrolyzing cellulose to glucose and other saccharides, said method comprising bringing to a reaction area a reaction mixture comprising of least one alphacellulose containing material, water, a calcium chloride catalyst and hydrochloric acid (HCl), said calcium chloride catalyst being present in an amount of from 5 to 60% by weight based on the total weight of the reaction mixture (dry basis) and being in an aqueous solution, said HCl being present in amount ranging from 0.025 to 1.0% by weight based on the total weight of the reaction mixture, adjusting the temperature of said reaction mixture to between 150° C. to 250° C. at a pressure of from 160 psig to 800 psig, for a finite retention time of up to one minute, in the reaction area to convert the alphacellulose to glucose and other saccharides.

2. The process of claim 1 wherein said retention time does not exceed 20 seconds.

3. The process of claim 1 wherein said calcium chloride catalyst is present in the reaction area in an amount of 55% by weight based on the total weight of the reaction mixture.

* * * * *